US010953969B2

(12) United States Patent
De Turckheim

(10) Patent No.: US 10,953,969 B2
(45) Date of Patent: Mar. 23, 2021

(54) ADJUSTABLE FRAME DEVICE FOR A PROFILED SAIL DEVICE, AND ADJUSTABLE PROFILED SAIL DEVICE

(71) Applicant: SoftWing SA, Lausanne (CH)

(72) Inventor: Hugues De Turckheim, La Seyne-sur-Mer (FR)

(73) Assignee: SoftWing SA, Lausanne (CH)

( * ) Notice: Subject to any disclaimer, the term of this patent is extended or adjusted under 35 U.S.C. 154(b) by 157 days.

(21) Appl. No.: 16/304,023

(22) PCT Filed: May 23, 2017

(86) PCT No.: PCT/EP2017/062451
§ 371 (c)(1),
(2) Date: Nov. 21, 2018

(87) PCT Pub. No.: WO2017/202858
PCT Pub. Date: Nov. 30, 2017

(65) Prior Publication Data

US 2020/0189707 A1 Jun. 18, 2020

(30) Foreign Application Priority Data

May 24, 2016 (DE) ..... 10 2016 109 564.8

(51) Int. Cl.
*B63H 9/061* (2020.01)
*B63H 9/065* (2020.01)

(52) U.S. Cl.
CPC ..... *B63H 9/065* (2020.02); *B63H 9/061* (2020.02)

(58) Field of Classification Search
CPC ... B63H 9/00; B63H 9/04; B63H 9/06; B63H 9/061; B63H 9/065
(Continued)

(56) References Cited

U.S. PATENT DOCUMENTS 4,064,821 A * 12/1977 Roberts, Jr. ..... B63H 9/061 114/102.26
4,386,574 A * 6/1983 Riolland ..... B63H 9/061 114/102.26
(Continued)

FOREIGN PATENT DOCUMENTS

DE 4207539 A1 9/1993
DE 19653851 A1 6/1998
(Continued)

OTHER PUBLICATIONS

European Patent Office; Search Report and Written Opinion in related International Patent Application No. PCT/EP2017/062451 dated Aug. 14, 2017; 11 pages.
(Continued)

*Primary Examiner* — Lars A Olson
(74) *Attorney, Agent, or Firm* — Dorton & Willis, LLP

(57) ABSTRACT

An adjustable frame device for a profiled sail device includes a fixed luff-sided first frame portion and a leech-sided second frame portion. The second frame portion includes a first flexible sail batten and a second flexible sail batten that are movable with respect to one another in a sail-batten longitudinal direction to adjust the frame device, with one of the sail battens serving as a compression batten and the other of the sail battens serving as a tension batten. An adjustable profiled sail device includes a first profiled surface against which air can flow, a second profiled surface against which air can flow, with the first profiled surface and the second profiled surface being spaced apart from one another, and an adjustable skeleton device disposed between the profiled surfaces. The skeleton device includes at least one adjustable frame device.

15 Claims, 4 Drawing Sheets

(58) Field of Classification Search
USPC ..... 114/102.22, 102.26, 102.29, 102.33, 114/39.31
See application file for complete search history.

(56) References Cited

U.S. PATENT DOCUMENTS

| | | | | |
|---|---|---|---|---|
| 4,624,203 | A | 11/1986 | Ferguson | |
| 4,757,779 | A * | 7/1988 | Graveline | B63H 9/061 114/102.26 |
| 5,603,276 | A | 2/1997 | Julien | |
| 6,070,834 | A | 6/2000 | Janker et al. | |
| 7,574,972 | B1 * | 8/2009 | Fairchild | B63H 9/061 114/102.22 |
| 9,199,709 | B2 * | 12/2015 | De Turckheim | B63H 9/061 |
| 9,975,618 | B2 * | 5/2018 | De Turckheim | B63H 9/061 |
| 2014/0224161 | A1 | 8/2014 | De Turckheim | |
| 2017/0106956 | A1 | 4/2017 | De Turckheim | |

FOREIGN PATENT DOCUMENTS

| | | | |
|---|---|---|---|
| DE | 102014103999 | A1 | 9/2015 |
| EP | 0511050 | A1 | 10/1992 |
| FR | 889560 | A | 1/1944 |
| GB | 2119730 | A | 11/1983 |
| WO | 2012168048 | A1 | 12/2012 |
| WO | 2015048854 | A1 | 4/2015 |
| WO | 2015144486 | A1 | 10/2015 |

OTHER PUBLICATIONS

German Patent Office; Office Action in related German Patent Application No. 10 2016 109 564.8 dated Apr. 28, 2017; 7 pages.

* cited by examiner

ADJUSTABLE FRAME DEVICE FOR A PROFILED SAIL DEVICE, AND ADJUSTABLE PROFILED SAIL DEVICE

CROSS-REFERENCE TO RELATED APPLICATIONS

This application is a national phase application under 35 U.S.C. § 371 of International Patent Application No. PCT/EP2017/062451, filed May 23, 2017 (pending), which claims the benefit of priority to German Patent Application No. DE 10 2016 109 564.8, filed May 24, 2016, the disclosures of which are incorporated by reference herein in their entirety.

TECHNICAL FIELD

The present invention relates to an adjustable frame device for a profiled sail device, the frame device comprising a fixed first frame section on the side of the luff and a second frame section on the side of the leech having a first flexurally flexible sail batten and a second flexurally flexible sail batten. Moreover, the present invention relates to an adjustable profiled sail device comprising a first profiled surface which can be flown against, having a sail outer side and a sail inner side, a second profiled surface which can be flown against, having a sail outer side and a sail inner side, the first profiled surface and the second profiled surface being spaced apart, and an adjustable skeleton device disposed between the profiled surfaces.

BACKGROUND

From WO 2012/168048 A1 a frame device for a profiled sail device is known, the frame device comprising a plurality of frame elements adjustable to one another, at least one frame element having a first profiled contour assigned to a sail surface and a second profiled contour assigned to another sail surface, the frame device comprising a profiled contour having at least one profiled contour section, which is formed with the aid of a profiled contour of the at least one frame element, and the frame device being adjustable between a first operating position and a second operating position, in which in the first operating position the first profiled contour of the at least one frame element forms at least one profiled contour section of the frame device for the first sail surface or for the second sail surface, and the second profiled contour of the at least one frame element forms no profiled contour section of the frame device for the sail surface, and in the second operating position the first profiled contour of the at least one frame element forms no profiled contour portion of the frame device for the sail surface and the second profiled contour of the at least one frame element forms at least one profiled contour portion of the frame device for the respective other sail surface.

From DE 10 2014 103 999 A1 a frame device for a profiled sail device is known, the frame device comprising at least one adjustable frame element, the at least one adjustable frame element having spaced apart longitudinal beams, which are assigned to sail surfaces spaced apart from one another, and transverse beams extending between the longitudinal beams, the longitudinal beams and the transverse beams delimiting quadrilaterals, each of which feature two diagonals having varying lengths as a function of the adjustment, and the diagonals each having a predetermined maximum length. Moreover, from DE 10 2014 103 999 A1 a profiled sail device is known, comprising spaced apart sail surfaces which can be flown against and which form profiled surfaces, a sail leading edge and an adjustable skeleton device situated between the sail surfaces, the skeleton device comprising at least one frame device according to one of the preceding claims.

From the EP 0 511 050 A1 a device is known, being made up of at least one aerodynamically shaped element, of which at least one part or one zone is foldable, for the actuation and/or for buoyancy under the action of the wind directed thereto, having two surfaces, respectively for the pressure (luv) or the suction (lee) side, in which at least one slot is provided to direct the flow of air tangentially to said element, said slot and said controls of said air flow having an effect in terms of geometry and the opening/closure by way of devices on the position and geometry of at least one part and/or one zone of said element, and said device furthermore comprising means which are regulating the geometry of said element, at least the shape and depth of the curvature.

From U.S. Pat. No. 4,624,203 A a batten structure for a flow profile is known for use in combination with similar batten structures, the batten structures are held in a spaced apart manner within a wing sail, the batten structure comprising: a beam having a front section including receptacles for the movable engagement with a support, such as a mast, and a rear portion fixedly connected to the front portion, a nose piece pivotally connected with the front end of the beam by way of pivoting means connected upstream of the receptacles, the nose piece comprising side surfaces which are formed to provide a front end section of a support surface, two flexurally flexible, elongated batten parts, each extending from opposite sides of the nose piece on the outside of the beam to the rear, the batten parts being rigidly connected by front ends to the nose piece and providing extensions of the side surfaces and being movably connected together by rear ends on the rear side of the rear end of the beam, and comprising elongated spreading means having opposite ends, connected to the batten parts to join the parts together and to allow a mobility relative to the beam, the arrangement of spreader, beam, nose piece and batten parts being in such a manner that a sail pressure acting upon a windward batten part can bend a central part of this batten part between the nose piece and the rear end of the beam against the beam and into a certain shape by direct or indirect contact with the beam in order to pivot the nose piece against the side directed windward, and the other batten part of the beam being held away from the beam and is held in a convex shape by the spreading means and by the pivoting of the nose piece, these shapes of the batten parts together with the nose piece forming a section of the winged sail subdivided into chambers.

SUMMARY

The object of the present invention is to structurally and/or functionally improve a frame device mentioned at the outset. Moreover, the object of the present invention is to structurally and/or functionally improve the profiled sail device mentioned at the outset.

This object is achieved by a frame device having features as shown and described herein.

The first frame section, with regard to an adjustability of the frame device, can be fixed. "Luff-sided" presently references a side facing a front sail end. The second frame section can be adjustable in relation to the first frame section. "Leech-sided" presently references a side facing a rear sail end. The first sail batten and the second sail batten each starting from the first frame section extend toward a leech side.

The frame device can comprise a longitudinal axis. The longitudinal axis of the frame device can extend between a luff side and a leech side. The longitudinal axis of the frame device can also be referred to as x-axis. The frame device can comprise a width. The width of the frame device can be oriented transversely in relation to the longitudinal axis of the frame device and perpendicular to a mast axis. A width direction of the frame device can also be referred to as y-direction. The frame device can have a height. The height of the frame device can be oriented transversely in relation to the longitudinal axis of the frame device and parallel to a mast axis. A height direction of the frame device can also be referred to as z-direction.

The frame device at the first frame section can comprise a width, which is greater than the diameter of a mast. The first sail batten and the second sail batten at the first frame section can be at a distance from each other, which at least approximately corresponds with a width of the first frame section. The first sail batten and the second sail batten can have a distance decreasing in the direction of a leech side. The sail batten longitudinal directions can at least in sections extend at least approximately parallel to the longitudinal axis of the frame device. The sail batten longitudinal directions at least in sections can extend slightly oblique to the longitudinal axis of the frame direction. The sail battens respectively are pressure-resistant. The sail battens each can serve as pressure battens for receiving and/or transmitting pressure forces. The sail battens are respectively tension-resistant. The sail battens each can serve as tension batten for receiving and/or transmitting tensile forces. The sail battens each can be flexurally flexible about a z-axis. The sail battens each can be elastically flexurally flexible. In the bent state, the sail battens each can serve as an energy store for potential energy. In the bent state, the sail battens each can comprise a bias force. The sail battens each can comprise a front end and a rear end. The rear ends of the sail battens each can be free. The rear ends of the sail battens can, in particular in the longitudinal direction of the sail battens, be movable in relation to each other. The sail battens each can serve for mounting at a sail. The sail battens each can be connectable to a sail.

The frame device can be elastically adjustable. The frame device starting from a neutral center position can be adjustable between a first end position and a second end position. The frame device under the action of force can, starting from the neutral center position, be adjustable in the direction of a first position and, if the action of force is eliminated or reduced, in the direction of the neutral center position. The frame device under action of force can, starting from the neutral center position, be adjustable in the direction of the second end position and, if the action of force is eliminated or reduced, in the direction of the neutral center position.

The frame device in the neutral center position can comprise a shape symmetric to the longitudinal axis of the frame device. If the frame device is adjusted in the direction of the first end position, the longitudinal axis can be bent into a first direction. If the frame device is adjusted in the direction of the second end position, the longitudinal axis can be bent into a second direction opposite to the first direction.

The frame device at the first sail batten can comprise at the side of the ends a first force transmission element. The frame device in the longitudinal direction of the sail battens can comprise a second force transmission element spaced apart from the first force transmission element. The frame device at the second sail batten can comprise at the side of the ends a first force transmission element. The frame device in the longitudinal direction of the sail battens can comprise a second force transmission element spaced apart from the first force transmission element. The first force transmission element and the second force transmission element reach can be at such a far distance from each other that at least one strand of a control tie can extend between a first force transmission element and a second force transmission element. The force transmission elements can be fixedly connected, in particular in a positive, non-positive and/or intermaterial manner, to the respective sail batten.

The first force transmission elements each can comprise an inner part for positioning at a sail inner side. The first force transmission elements each can comprise an outer part for positioning at a sail outer side. The inner part and the outer part each can be fixedly connected in a releasable manner to each other. For example, the inner part and the outer part each can be screwed together. The inner parts can be fixedly connected to the respective sail batten, in particular in a positive, non-positive and/or intermaterial manner.

The frame device can comprise a first control tie. The first control tie can be effective between the first force transmission element of the first sail batten and the second force transmission element of the second sail batten. The frame device can comprise a second control tie. The second control tie can be effective between the first force transmission element of the second sail batten and the second force transmission element of the first sail batten. The control ties each can serve to transmit tensile forces. The control ties each can be flexible. A cable can respectively serve as a control tie.

The first force transmission element and the second force transmission element each can comprise at least one idler pulley. The first force transmission element of the first sail batten and the second force transmission element of the second sail batten each can comprise at least one idler pulley for the first control tie. The first force transmission element of the second sail batten and the second force transmission element of the first sail batten each can comprise at least one idler pulley for the second control tie. The first force transmission elements each can comprise one fastening portion for fixedly tethering a control tie. The fastening portions each can be situated at an inner part of the first fastening element. The first force transmission elements each can comprise two idler pulleys. At the first force transmission elements, respectively one idler pulley can serve for positioning at the inner side of the sail and one idler pulley for positioning at the outer side of the sail. One idler pulley can be disposed at an inner part of the first force transmission element. One idler pulley can be disposed at an outer part of the first force transmission element. The idler pulleys of a first force transmission element can comprise rotary axes which are parallel to each other. The second force transmission elements each can comprise two idler pulleys. At the second force transmission elements, respectively one idler pulley can serve for positioning at the inner side of the sail and one idler pulley for positioning at the outer side of the sail. The first idler pulley and the second idler pulley each can comprise rotary axes which are perpendicular to each other.

The first control tie can be guided at the second sail batten in the manner of a bowstring. The second control tie can be guided at the first sail batten in the manner of a bowstring. The first control tie and the second control tie each can be guided at a luff-sided end of the frame device and at a leech-sided end of the frame device in a tensile-force transmitting manner.

A first pulley can be formed between the first force transmission element of the first sail batten and the second force transmission element of the second sail batten. A second pulley can be formed between the second force transmission element of the first sail batten and the first force transmission element of the second sail batten. The pulleys each can be configured as factorial pulleys. For example, the pulleys each can have three supporting control tie sections.

The frame device can comprise at least one rod element articulatedly connected to the first sail batten and the second sail batten. The at least one rod element by its rod longitudinal axis can extend at least approximately in a y-direction. The at least one rod element can be pressure-resistant. The at least one rod element can serve to receive and/or transmit pressure forces. The frame device can comprise at least one flexible pull element disposed between the first sail batten and the second sail batten. The at least one pull element in the tensioned state can extend by its longitudinal axis at least approximately in a y-direction. The at least one pull element can be tension-resistant. The at least one pull element can serve to transmit tensile forces.

The first frame device can comprise an arc element, a rod element and two first connecting elements for interconnecting the arch element and the rod element. The arch element can form a luff-sided end of the frame device. The arch element can have a clip-like curved shape. The rod element of the first frame section can extend by its rod longitudinal axis at least approximately in a y-direction. The rod element of the first frame section can be pressure-resistant. The rod element of the first frame section can serve to receive and/or transmit pressure forces. The arch element and the rod element can form a triangular frame. The first connecting elements each can have a triangular shape. The first connecting elements respectively can have one receptacle for one end of the arch element and for one end of the rod element of the first frame section. The two first connecting elements can have at least respectively one idler pulley. The two first connecting elements each can have two idler pulleys. At the first connecting elements respectively one idler pulley can serve for positioning on the inside of the sail and for positioning on the outside of the sail. The two idler pulleys of the first connecting element each can comprise rotary axes which are perpendicular to each other.

The frame device can comprise two sleeve-shaped second connecting elements for the interconnection of the first frame section and the second frame section. The second connecting elements each can have one receptacle for one end of the arch element and for one end of a sail batten.

The frame device can comprise two third connecting elements having hinges for articulatedly connecting the rod element to the first sail batten and the second sail batten. The third connecting elements can be fixedly connected to the respective sail batten, in particular in a positive, non-positive and/or intermaterial manner. The third connecting elements can comprise respectively one receptacle for one end of the at least one rod element of the frame device. The third connecting elements each can have a triangular shape.

The frame sections can be produced in and assembled from multiple parts. The frame sections can be composed of individual rods, pipes, segments, cables and/or connecting elements. The tubes and/or rods each can comprise a round cross section, a polygonal cross section or a quadrangular cross section. The tubes and/or rods can have a standardized cross section. The tubes and/or rods may be produced from a drawn material, from a carbon material or from a glass material. The segments and/or connecting elements can be produced from a thermoplastic material. The segments and/or connecting elements can be produced in a generative process. The segments and/or connecting elements can be produced in a 3D printing process. The segments and/or connecting elements can be produced in an injection molding process. The frame sections can be produced in a sandwich construction. The frame sections can comprise passages for operating cables. The frame sections at least partially can be produced as single pieces. The frame sections can be foam sandwich components. The frame sections can comprise a material such as wood, light metal alloy, plastic and/or fiber composite. The light metal alloy can be an aluminum alloy or be titanium alloy. The plastic material can be filled. Talc, chalk, kaolin, carbon black, glass beads and/or fiber glass can serve as fillers. The fiber composite material can have a matrix. Duromers, also called synthetic resins, elastomers and/or thermoplastics can serve as a matrix. The fiber composite material can comprise fibers. Glass fibers, carbon fibers, ceramic fibers, aramid fibers, boron fibers, basalt fibers, steel fibers, natural fibers and/or nylon fibers can serve as fibers.

The frame device can have an opening for accommodating a mast. In this way, the frame device can be fixed to the mast. The frame device delimited by the mast can be fixed, in particular movable in the direction orthogonal to a mast axis, in a limitedly movable manner. The frame device can be pivotable about the mast. Thus, a profiled sail device, for example at a turn or a jibb, can pass from one side to another side. The frame device can be movable at the mast in the direction of extension of the mast axis. Thus, the profiled sailing device can be hoisted, salvaged or reefed.

The frame device can be actively adjustable. An actively adjustable frame device can comprise force transmission elements and control ties. The frame device can be passively adjustable. A passively adjustable frame device can be configured without force transmission elements and/or control ties. An actively adjustable frame device can be configured in a more resilient manner than a passively adjustable frame device.

Moreover, the object underlying the present invention can be achieved by a profiled sail device having features as shown and described herein.

The profiled sail device can be positionable at a mast. The profiled sail device can serve for use with a sailing craft. The sailing craft can be a watercraft or a land vehicle. The sailing craft can be a sailboat, an ice sailor or a land sailing vessel. The sailboat can be a monohull or a multihull. The multihull can comprise in particular two or three hulls. The multihull can be a catamaran or a trimaran. The sailboat can be a hydrofoil or an airfoil boat. The sailboat can comprise a hydrofoil.

The sailboat can have a mast or a plurality of masts. The sailboat can be a sloop. The sailboat can be a schooner, a ketch or a yawl. The sailboat can be a pleasure boat. The sailboat can be a racing boat. The sailboat can be a regatta boat. The sailboat can be a travel boat. The profiled sail device can be used as a fore- and aft sail. The profiled sail device can be used as a mainsail. The profiled sail device can be used as foresail, schooner sail or mizzen sail. The profiled sail device can be an oversize sail.

The skeleton device can have at least one actively adjustable frame device. The skeleton device can have at least one passively adjustable frame device. The at least one frame device can comprise a principal plane which is substantially orthogonal to an axis of the mast. The skeleton device can have a plurality of frame devices. The frame devices by their principal planes can be situated substantially parallel to each other. The frame devices in the direction of extension of a mast can be situated one above the other. The frame devices can be at a distance from each other of respectively 0.5 m to approximately 2 m.

The frame devices can be adjustable independent from each other. A plurality of frame devices can be collectively adjustable. A plurality of frame devices can be adjustable in groups. A plurality of frame devices can be adjustable to each other in a coordinated manner. A plurality of frame devices can be adjustable to each other in groups in a coordinated manner. Actively adjustable frame devices and passively adjustable frame devices can be disposed in an alternating manner. At least one passively adjustable frame device can be disposed between two actively adjustable frame devices. At least one actively adjustable frame device can be disposed between two passively adjustable frame devices.

For this reason, a profile of the profiled sail device is adjustable independent from an advancing flow. An adjusted profile can maintain its profiling even when the advancing flow changes. The camber of a profile is adjustable. A profile is invertible. A profile which is optimized for an advancing flow onto the first sail surface is adjustable. A profile which is optimized for an advancing flow onto the second sail surface is adjustable. A propelling force acting upon a mast can be adjusted. A point of contact of a propelling force acting upon a mast can be adjusted. A moment acting upon a hull can be adjusted. The profiled sail device, in particular the at least one frame device, can correspond to the principles of a lightweight construction. The profiled sail device, in particular the at least one frame device, has a high rigidity and resistance. The profiled sail device can be easily handled.

The at least frame device in the operating position can be adjustable between the first end position and the second end position. For this reason, expedient profiled surfaces can be adjusted for both, the first sail surface and the second sail surface. The profiled surface for the first sail surface and the profiled surface for the second sail surface can each be different.

The profiled sail device can form a first hydrofoil profile and a second hydrofoil profile. The first hydrofoil profile can be an asymmetrical hydrofoil profile and the second hydrofoil profile can be a hydrofoil profile which is complementary to the first hydrofoil profile. The hydrofoil profile can be a normal profile, the side of which can be flown against (luv) is convex and the opposite side of which (lee) is cambered in an s-shape. The hydrofoil profile can be used for a wide speed range. A dynamic propulsion is generatable by the hydrofoil profile.

The profiled sail device can be configured as a hollow profile. The profiled sail device can have an interior. The profiled sail device can have an outer sleeve. The profiled sail device can have a sailcloth. The sailcloth can form an outer sleeve. The sailcloth can delimit the interior. The skeleton device can be situated in the interior. The first profiled surface and the second profiled surface which can be flown against can be situated opposite each other. The sail outsides can be directed away from the interior. The sail insides can be directed toward the interior.

The sailcloth can be guided at the skeleton device in an abutting manner. The sailcloth can be guided at the skeleton device as function of the adjustment. The sailcloth at least in sections can be guided at the skeleton device in an abutting manner. The sailcloth as a function of the adjustment can be lifted in sections off the skeleton device.

The sailcloth in sections can be held between inner parts and outer parts of first force transmission elements of the at least one frame device. The sailcloth in sections can be clamped between inner parts and outer parts of first force transmission elements of the at least one frame device.

The sailcloth can comprise openings for the passage of control ties of the at least one frame device. The sailcloth can comprise openings for the passage of idler pulleys.

"Can" in particular references optional features of the present invention. As a consequence, there is respectively one exemplary embodiment of the present invention which comprises the respective feature or features.

The present invention enables a propulsion having a greater efficiency. A dual-sided functionality is made possible. A camber is adjustable independent from the wind pressure. An operability is simplified. A maximum camber is limitable or limited. A maximum camber is adjustably limitable or limited in a plurality of ways via a cross section of a profiled sail device. A load capacity of a limitation is increased. A load caused by the limitation is distributively receivable. A limitation is distributively receivable via a cross section of a profiled sail device. A weight is reduced. A load capacity is increased. An operability is simplified. An operating effort is reduced. A manufacturing expense is reduced. An operating ability is reliably ensured.

Exemplary embodiments of the present invention are subsequently described in greater detail on the basis of the figures. From this description, further features and advantages result. Concrete features of these exemplary embodiments can represent general features of the present invention. Features of these exemplary embodiments connected to other features can also represent individual features of the present invention.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate exemplary embodiments of the invention and, together with a general description of the invention given above, and the detailed description given below, serve to explain the principles of the invention.

DETAILED DESCRIPTION

Figure 1:
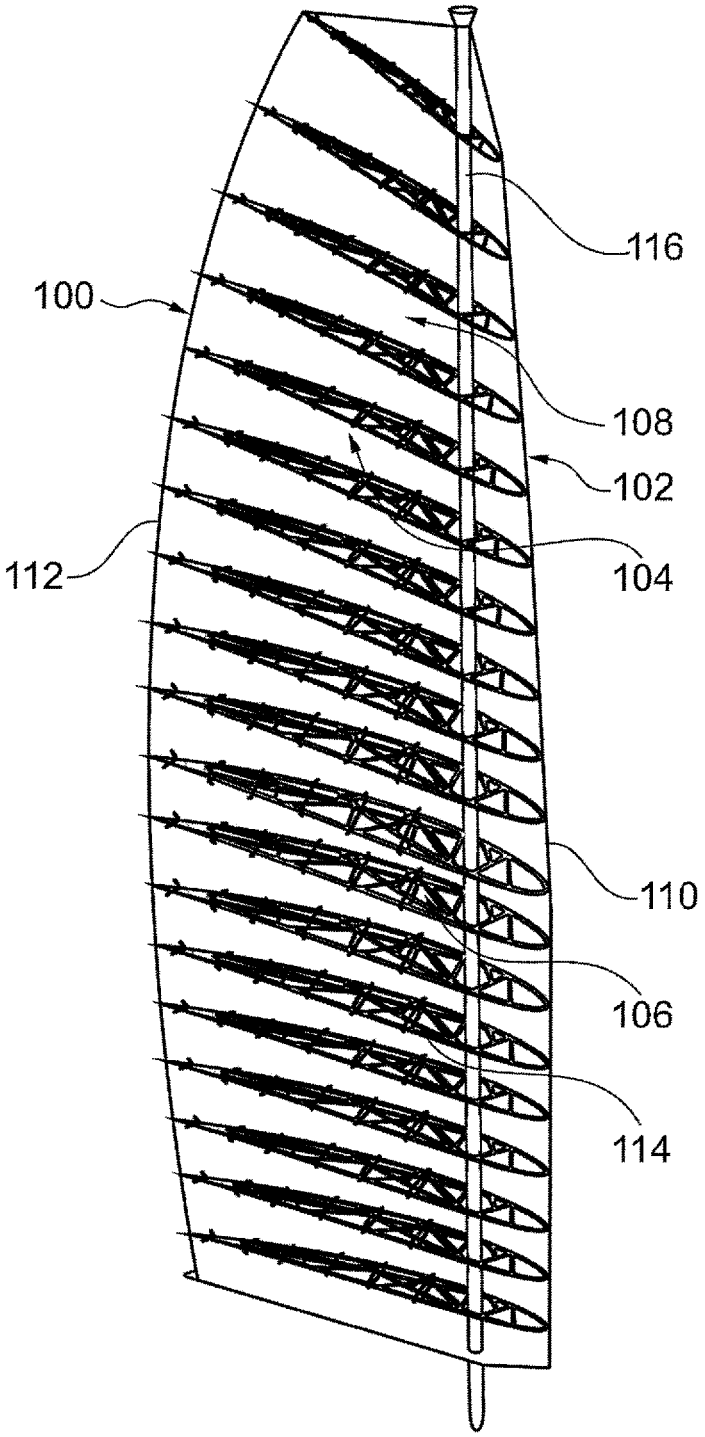
FIG. 1 shows an adjustable profiled sail device having outside lying sail surfaces and an inside lying skeleton structure.

FIG. 1 shows an adjustable profiled sail device 100 having outside lying profiled surfaces 102, 104 and an inside lying skeleton device 106. Profiled sail device 100 serves for the actuation of a sailing craft here not shown in greater detail. Skeleton device 106 dictates the shape of the profiled sail device. Profiled surfaces 102, 104 form sail surfaces of profiled sail device 100 and are stretched over skeleton device 106. Profiled sail device 100 comprises a first profiled surface 102 and an opposite lying second profiled surface 104. Between profiled surfaces 102, 104, an interior 108 is formed, in which skeleton device 106 is disposed. Profiled sail device 100 comprises a hydrofoil profile, by which a dynamic propulsion can be generated with the aid of a wing profile effect. The hydrofoil profile of profiled sail device 100 is adjustable between two end positions. Operating positions for an advancing flow against first profiled surface 102 and operating positions for an advancing flow against second profiled surface 104 can be adjusted. For this purpose, the sail surface to be flown against has a convexly cambered surface. The opposite lying sail surface has a cambered surface in an s-shape. Profiled sail device 100 has a profile nose 110 having a nose radius and a profile trailing edge 112 having a trailing edge angle. The longest line from profile nose 110 to profile trailing edge 112, which is identical to the profile chord, determines the profile depth. The profile camber results in the maximum deviation of a skeleton line from the profile chord. Skeleton line refers to the line which in a cross section of profiled sail device 100 is positioned exactly between profiled surfaces 102, 104. The profile contour of profiled sail device 100 is also symmetrical around the skeleton line. A different definition is: The skeleton line is the connecting line of centers of a circle inscribed into a profile. The profile thickness is the maximum diameter of a circle on the skeleton line within the profile. The profile camber decisively determines the maximum propulsion and is substantial for a moment coefficient.

Profiled surfaces 102, 104 can also be made of a woven cloth made from synthetic fibers. Profiled surfaces 102, 104 can be made from a laminated sail, in which fibers are adhesively bonded with foils or a woven fabric. Profiled surfaces 102, 104 can be formed by a membrane sail, in which reinforced fibers are introduced already during manufacture of the sail according to an expected load line. Profiled surfaces 102, 104 can comprise synthetic fibers, for example of polyamide, polyester, polyethylene naphthalate, aramid, and/or carbon fiber.

Skeleton device 106 comprises a plurality, presently 19, adjustable frame devices, such as 114. Frame devices 114 each are actively or passively adjustable. Frame devices 114 each comprise a fixed luff-sided frame section and a leech-sided second frame section including flexible sail battens. As a result, profiled sail device 100 can be adjusted.

Profiled sail device 100 is disposed at a mast 116. Mast 116 extends when profiled sail device 100 is hoisted into interior 108 and through openings in frame devices 114. There is a play between the edges of the openings and the mast. Frame devices 114 in a limited manner are displaceable at mast 116 in the direction of the mast axis. Frame devices 114 are movable at mast 116 in the direction of the mast axis. Frame devices 114 are pivotable about mast 116. For this reason, profiled sail device 100 is pivotable about mast 116. Mast 116 extends in the hydrofoil profile behind profile nose 110, so that a smaller section of profiled sail device 100 extends between mast 116 and profile nose 110, and a larger section of profiled sail device 100 extends between mast 116 and profile trailing edge 112. Mast 116 in the present case is fixedly connected, in particular in a rotationally fixed manner, to a vessel body such as a hull. Mast 116 can stand on a keel and be guided through a deck. Alternatively, mast 116 can stand on the deck and be braced from below on the keel.

Figure 2:
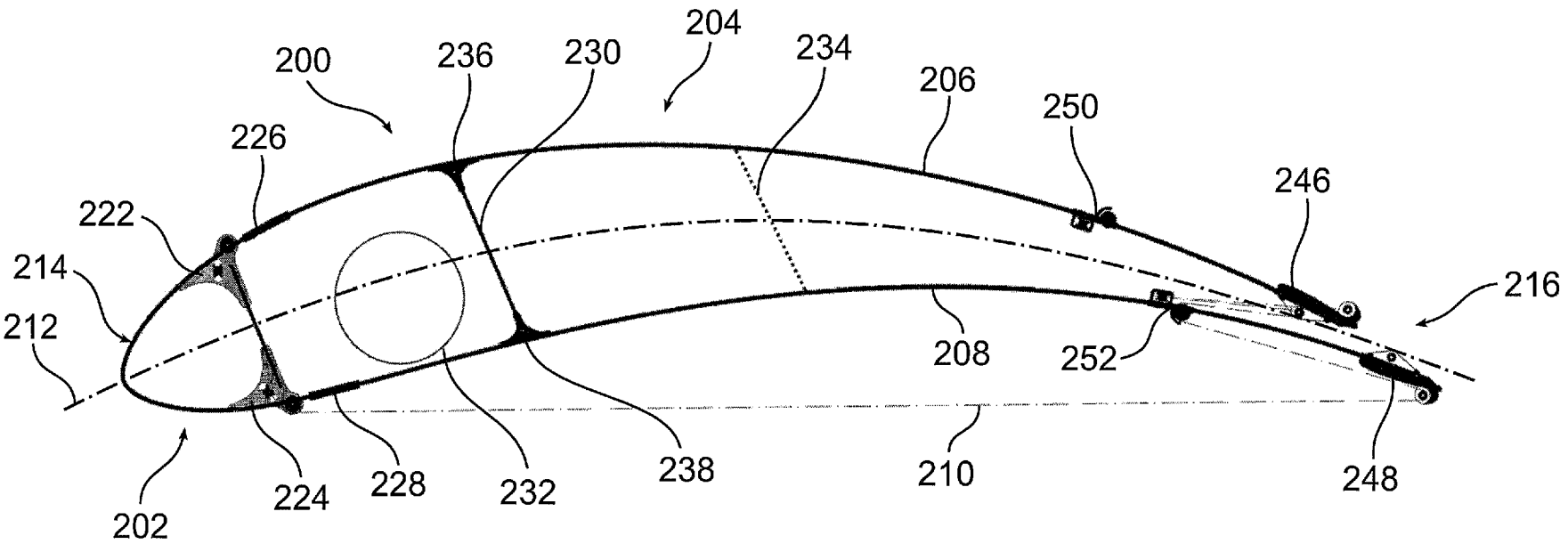
FIG. 2 shows an adjustable frame device for a profiled sail device comprising a fixed luff-sided frame section, a leech-sided frame section having sail battens and a control tie.

FIG. 2 shows an actively adjustable frame device 200, for example frame device 114 according to FIG. 1, for a profiled sail device, for example profiled sail device 100 according to FIG. 1, having a fixed luff-sided frame section 202, a leech-sided frame section 204 including sail battens 206, 208 and a control tie 210. For reasons of clarity, in the present case only one control tie 210 is shown and described but, in fact, frame device 200 has a further symmetrically situated and effective control tie for adjusting frame device 200 in an opposite direction.

Frame device 200 comprises a longitudinal axis 212, which extends between a luff side 214 and a leech side 216, and a width oriented transversely thereto. Frame device 200 starting from a neutral center position is adjustable optionally into a first end position or into a second end position. In the neutral central position, longitudinal axis 212 is straight. When adjusting in the direction of the end positions, the longitudinal axis 212 is bent. FIG. 2 shows frame device 200 in an end position.

Figure 3:
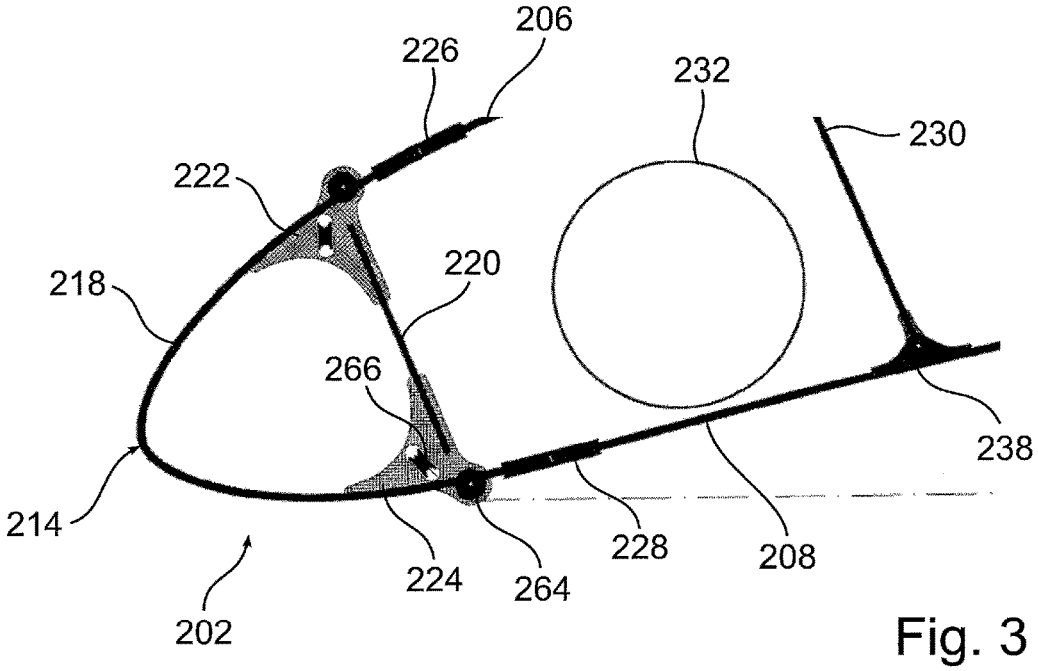
FIG. 3 shows a detailed view of a luff-sided frame section having an adjustable frame device.

FIG. 3 shows luff-sided frame section 202 of frame device 200 in a detailed view. Luff-sided frame section 202 is fixed with regard to an adjustability of frame device 200 and comprises an arch element 218, a rod element 220 and two first connecting elements 222, 224 to interconnect arch element 218 and rod member 220. Arch element 218 comprises a clip-like bent shape and forms a luff-sided end of frame device 200. Rod element 220 serves for receiving and/or transmitting pressure forces and extends by its rod longitudinal axis transversely to longitudinal axis 212. Arch element 218 and rod element 220 form a triangular frame. First connecting elements 222, 224 each have a triangular shape, are disposed at arch element 218 and comprise respectively one receptacle for one end of rod element 220.

Frame device 200 comprises two shell-shaped second connecting elements 226, 228 for interconnecting luff-sided frame section 202 and leech-sided frame section 204. Second connecting elements 226, 228 comprise respectively one receptacle for one end of arch element 218 and for one end of a sail batten 206, 208.

Sail battens 206, 208 are respectively connected by one end to connecting element 226 or 228 and respectively extend starting from luff-sided frame section 202 to leech-side 216. Sail battens 206, 208 each are pressure-resistant and tension-resistant. Sail battens 206, 208 each serve as pressure batten for receiving and/or transmitting pressure forces and/or as pull batten for receiving and/or transmitting tensile forces. Sail battens 206, 208 each are elastically flexurally flexible.

Frame device 200 comprises a rod element 230 articulatedly connected to first sail batten 206 and second sail batten 208. Rod element 230 serves for receiving and/or transmitting pressure forces and extends by its rod longitudinal axis transversely to longitudinal axis 212. Rod element 220, sail battens 206, 208 and rod element 230 form a quadrangular frame, by which frame device 200 is disposed at a mast 232. Frame device 200 comprises a control tie 234 acting between sail battens 206, 208, which in the tensioned state extends transversely to longitudinal axis 212 and serves for transmitting tensile forces.

Figure 5:
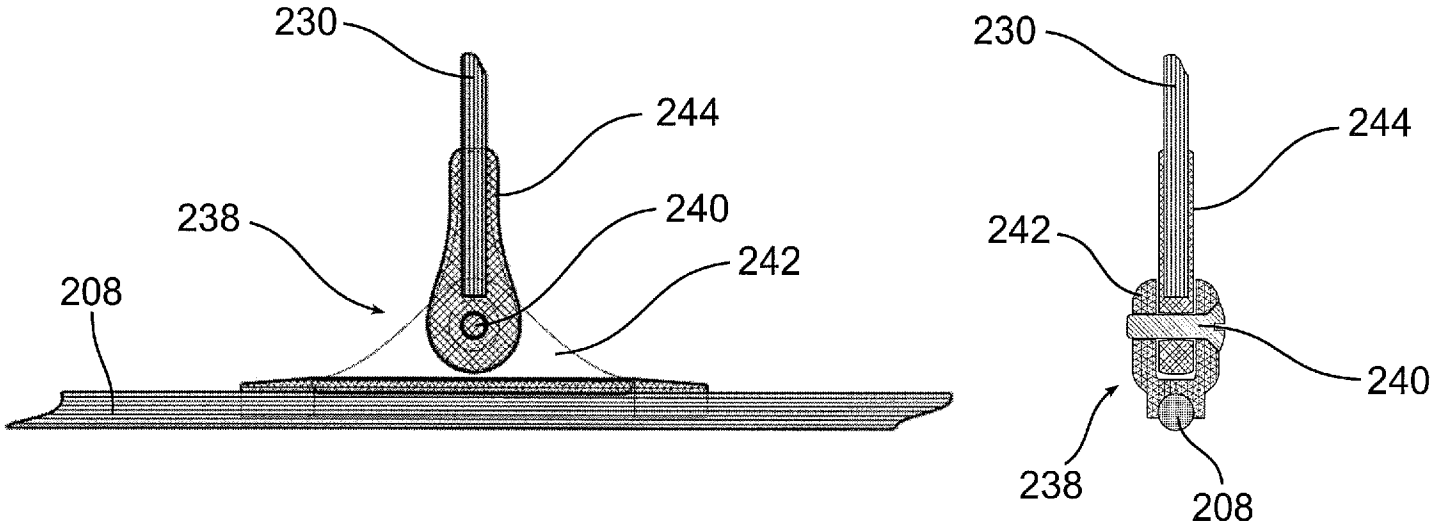
FIG. 5 shows in a longitudinal-sectional view and a cross-sectional view a rod element articulatedly connected with a sail batten.

For the articulated connection of rod element 230 to sail battens 206, 208, frame device 200 comprises two third connecting elements 236, 238 having hinges, for example 240, for articulatedly connecting rod element 230 with sail battens 206, 208. Third connecting elements 236, 238 comprise respectively one hinge part, for example 242, assigned to a sail batten 206, 208, and one hinge part, for example 244, assigned to rod element 230. FIG. 5 shows rod element 230 articulatedly connected to sail batten 208 in a longitudinal sectional view and in a cross sectional view. Hinge part 242 is fixedly connected to sail batten 208, in the present case, is clamped. Hinge part 244 is fixedly connected to rod element 230.

Sail battens 206, 208 extend along longitudinal axis 212 and starting from rod element 230 have a distance from each other which diminishes in the direction of leech side 216. The leech-sided ends of sail battens 206, 208 are each free and in particular are movable toward each other in the longitudinal direction of the sail battens. Sail battens 206, 208 serve for mounting a sail and each can be connectable to the sail.

Frame device 200 at sail battens 206, 208 comprises first force transmission elements 246, 248 at the end sides and two force transmission elements 250, 252 at a distance from the first force transmission elements. Force transmission elements 246, 250 are fixedly connected to first sail batten 206. Force transmission elements 248, 252 are fixedly connected to second sail batten 208.

First force transmission elements 246, 248 comprise respectively one inner part for positioning at a sail inside and an outer part for positioning at a sail outside. The inner parts are fixedly connected to sail battens 206, 208. An inner part and an outer part are screwed to each other. Respectively one sail can be clamped between an inner part and an outer part.

Respectively one attachment hole, for example, 254, and one idler pulley, for example 256, are situated at the inner parts of first force transmission elements 246, 248. Respectively one idler pulley, for example 258, is situated at the outer parts of first force transmission elements 246, 248. Idler pulleys 256, 258 comprise rotary axes which are parallel to each other. Respectively two idler pulleys, for example 260, 262, are situated at two force transmission elements 250, 252. Idler pulleys 260, 262 comprise rotary axes which are perpendicular to each other.

Figure 4:
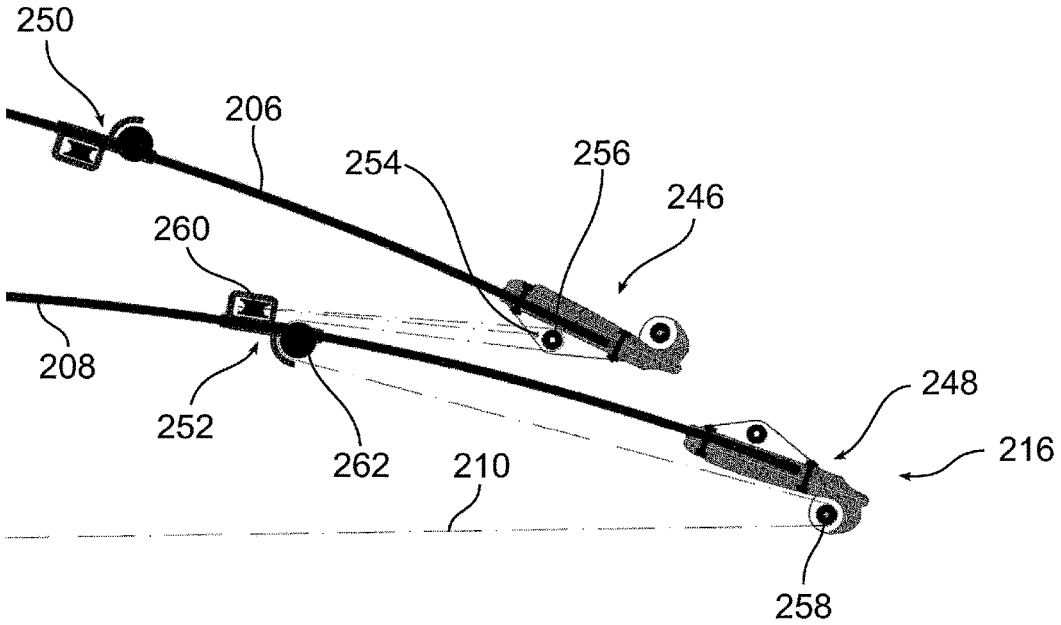
FIG. 4 shows a detailed view of sail battens of a leech-sided frame section of an adjustable frame device having force transmission elements and a control tie.

Control tie 210 acts between first force transmission element 246 of first sail batten 206 and second force transmission element 252 of second sail batten 208 and serves for transmitting tensile forces. Control tie 210 is tension-resistantly attached at the inside of the sail at attachment hole 254 of first force transmission element 246, guided around idler pulley 260 of second force transmission element 252, idler pulley 256 of first force transmission element 246 and idler pulley 262 of second force transmission element 252. In so doing, a pulley is formed at the inside of the sail. Subsequently, control tie 210 is guided at idler pulley 256 to an outside of a sail and around idler pulley 258 of first force transmission element 248. FIG. 4 shows sail battens 206, 208 of leech-sided frame section 204 of frame device 200 having force transmission elements 246, 248, 250, 252 and control tie 210 in a detailed view.

Subsequently, control tie 210 is guided in a chordally at second sail batten 208 in the direction of luff side 214. First connecting elements 222, 224 comprise respectively two idler pulleys, for example 264, 266, having rotary axes which are perpendicular to each other. At idler pulley 264, control tie 210 is subsequently guided toward an inside of the sail and around idler pulley 266 toward a boat deck.

For adjusting frame device 200 into the end position shown in FIG. 2 starting from a neutral center position, a tensile force is applied to control tie 210, so that first force transmission element 246 of first sail batten 206 and second force transmission element 252 of second sail batten 208 are pulled toward each other. In this instance, a pressure force is applied to first sail batten 206 and a tensile force is applied to second sail batten 208, the ends on the leech side of sail battens 206, 208 are shifted toward each other, sail battens 206, 208 and longitudinal axis 212 are flexurally bent, as it is shown in FIG. 2. In the bent state, sail battens 206, 208 are pre-biased and serve as mechanical energy store. If control tie 210 is again released, frame device 200 returns elastically into the neutral center position.

While the present invention has been illustrated by a description of various embodiments, and while these embodiments have been described in considerable detail, it is not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit and scope of the general inventive concept.

REFERENCE CHARACTERS

100 profiled sail device
102 profiled surface
104 profiled surface
106 skeleton device
108 Interior
110 profile nose
112 profile trailing edge
114 frame device
116 Mast
200 frame device
202 luff-sided frame section
204 leech-sided frame section
206 first sail batten
208 second sail batten
210 first control tie
212 longitudinal axis
214 luff side
216 leech side
218 arch element
220 rod element
222 first connecting element
224 first connecting element
226 second connecting element
228 second connecting element
230 rod element
232 Mast
234 control tie
236 third connecting element
238 third connecting element
240 hinge
242 hinge part
244 hinge part
246 first force transmission element
248 first force transmission element
250 second force transmission element
252 second force transmission element
254 attachment hole
256 idler pulley
258 idler pulley
260 idler pulley
262 idler pulley
264 idler pulley
266 idler pulley

What is claimed is:

1. An adjustable frame device for a profiled sail device, the frame device comprising:

a fixed first frame section on a luff side of the sail device;

a second frame section on a leech side of the sail device;

the second frame section having a first flexurally flexible sail batten and a second flexurally flexible sail batten;

wherein the first sail batten and the second sail batten are movable relative to each other along a sail batten longitudinal direction thereby adjusting the frame device;

wherein one of the first or second sail battens serves as a pressure batten and the other of the first or second sail battens serves as a pull batten; and two sleeve-shaped second connecting elements interconnecting the first frame section and the second frame section.

2. The adjustable frame device of claim 1, further comprising:

a first force transmission element on the leech-end side of the first sail batten;

a second force transmission element on the first sail batten and spaced apart from the first force transmission element in the longitudinal direction of the first sail batten;

a third force transmission element on the leech-end side of the second sail batten; and a fourth force transmission element on the second sail batten and spaced apart from the third force transmission element in the longitudinal direction of the second sail batten.

3. The frame device of claim 2, wherein the first force transmission element and the third transmission element each comprise an inner part configured to be positioned at a sail inner side, and an outer part configured to be positioned at a sail outer side.

4. The frame device of claim 2, further comprising:

a first control tie that is active between the first force transmission element of the first sail batten and the fourth force transmission element of the second sail batten; and a second control tie that is active between the third force transmission element of the second sail batten and the second force transmission element of the first sail batten.

5. The frame device of claim 4, wherein the first, second, third, and fourth force transmission elements each comprise at least one idler pulley.

6. The frame device of claim 4, wherein:

the first control tie is guided chordally at the second sail batten; and the second control tie is guided chordally at the first sail batten.

7. The frame device of claim 2, further comprising:

a first pulley configured between the first force transmission element of the first sail batten and the fourth force transmission element of the second sail batten; and a second pulley configured between the second force transmission element of the first sail batten and the third force transmission element of the second sail batten.

8. The frame device of claim 1, further comprising:

at least one rod element articulatedly connected to the first sail batten and the second sail batten; and at least one pull element situated between the first sail batten and the second sail batten.

9. The frame device of claim 1, wherein the first frame section comprises:

an arch element;

a rod element; and two first connecting elements interconnecting the arch element and the rod element.

10. An adjustable, profiled sail device, comprising:

a first profiled surface that can be flown against, the first profiled surface having a sail outer side and a sail inner side;

a second profiled surface that can be flown against, the second profiled surface having a sail outer side and a sail inner side;

wherein the first profiled surface and the second profiled surface are spaced a distance from each other;

and an adjustable skeleton device disposed between the first and second profiled surfaces;

wherein the skeleton device comprises at least one frame device according to claim 1.

11. The profiled sail device of claim 10, wherein the skeleton device comprises at least one actively adjustable frame device and at least one passively adjustable frame device.

12. The profiled sail device of claim 10, further comprising a sailcloth, the sailcloth guided in an abutting manner at the skeleton device.

13. The profiled sail device of claim 12, wherein the sailcloth comprises openings for the passage of control ties of the at least one frame device.

14. An adjustable frame device for a profiled sail device, the frame device comprising:

a fixed first frame section on a luff side of the sail device;

a second frame section on a leech side of the sail device;

the second frame section having a first flexurally flexible sail batten and a second flexurally flexible sail batten;

wherein the first sail batten and the second sail batten are movable relative to each other along a sail batten longitudinal direction thereby adjusting the frame device;

wherein one of the first or second sail battens serves as a pressure batten and the other of the first or second sail battens serves as a pull batten;

wherein the first frame section comprises:

an arch element, a rod element, and two first connecting elements interconnecting the arch element and the rod element; and wherein:

the two first connecting elements each comprise at least one idler pulley, or the frame device further comprises two third connecting elements having hinge joints articulatedly connecting the rod element to the first sail batten and the second sail batten.

15. An adjustable, profiled sail device, comprising:

a first profiled surface that can be flown against, the first profiled surface having a sail outer side and a sail inner side;

a second profiled surface that can be flown against, the second profiled surface having a sail outer side and a sail inner side;

wherein the first profiled surface and the second profiled surface are spaced a distance from each other;

and an adjustable skeleton device disposed between the first and second profiled surfaces;

wherein the skeleton device comprises at least one adjustable frame device, the frame device comprising:

a fixed first frame section on a luff side of the sail device, a second frame section on a leech side of the sail device, the second frame section having a first flexurally flexible sail batten and a second flexurally flexible sail batten, wherein the first sail batten and the second sail batten are movable relative to each other along a sail batten longitudinal direction thereby adjusting the frame device, and wherein one of the first or second sail battens serves as a pressure batten and the other of the first or second sail battens serves as a pull batten;

first force transmission elements on the leech-end sides of the first and second sail battens of the at least one frame device;

each first force transmission element comprising an inner part configured to be positioned at a sail inner side, and an outer part configured to be positioned at a sail outer side; and a sailcloth that, in sections, is held between the inner parts and the outer parts of the first force transmission elements.

* * * * *